US006561613B2

(12) United States Patent
Cunnagin et al.

(10) Patent No.: US 6,561,613 B2
(45) Date of Patent: May 13, 2003

(54) METHOD FOR DETERMINING PRINTHEAD MISALIGNMENT OF A PRINTER

(75) Inventors: Stephen Kelly Cunnagin, Lexington, KY (US); Eric Todd DeBusschere, Lexington, KY (US); Charles Aaron Judge, Lexington, KY (US); David Golman King, Shelbyville, KY (US); Patrick Laurence Kroger, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 55 days.

(21) Appl. No.: 09/972,101

(22) Filed: Oct. 5, 2001

(65) Prior Publication Data

US 2003/0067503 A1 Apr. 10, 2003

(51) Int. Cl.[7] ..... B41J 29/393; B41J 29/38

(52) U.S. Cl. ..... 347/19; 347/14

(58) Field of Search ..... 347/19, 23, 16, 347/14, 15, 10, 9, 11, 12, 82, 49, 85–87; 358/504, 506, 406; 400/73

(56) References Cited

U.S. PATENT DOCUMENTS

| | | | | |
|---|---|---|---|---|
| 4,180,704 A | | 12/1979 | Pettit | |
| 4,435,674 A | | 3/1984 | Hevenor et al. | |
| 5,160,938 A | | 11/1992 | Fargo et al. | |
| 5,262,797 A | | 11/1993 | Boeller et al. | |
| 5,289,208 A | | 2/1994 | Haselby | |
| 5,387,976 A | * | 2/1995 | Lesniak | 356/379 |
| 5,404,020 A | | 4/1995 | Cobbs | |
| 5,448,269 A | | 9/1995 | Beauchamp et al. | |
| 5,508,826 A | | 4/1996 | Lloyd et al. | |
| 5,534,895 A | | 7/1996 | Lindenfelser et al. | |
| 5,600,350 A | | 2/1997 | Cobbs et al. | |
| 5,618,120 A | | 4/1997 | Ishikawa | |
| 5,796,414 A | | 8/1998 | Sievert et al. | |
| 5,835,108 A | | 11/1998 | Beauchamp et al. | |
| 5,847,722 A | | 12/1998 | Hackleman | |
| 5,856,833 A | | 1/1999 | Elgee et al. | |
| 5,905,512 A | | 5/1999 | Beauchamp | |
| 5,963,225 A | | 10/1999 | Sugiyama | |
| 5,975,674 A | | 11/1999 | Beauchamp et al. | |
| 5,988,784 A | | 11/1999 | Takemura et al. | |
| 6,003,980 A | | 12/1999 | Sheinman et al. | |
| 6,036,298 A | | 3/2000 | Walker | |
| 6,056,386 A | | 5/2000 | Nohata et al. | |
| 6,076,915 A | | 6/2000 | Gast et al. | |
| 6,084,607 A | | 7/2000 | Matsuda | |
| 6,089,766 A | | 7/2000 | Yamada et al. | |
| 6,109,721 A | | 8/2000 | Kim | |
| 6,109,745 A | | 8/2000 | Wen | |
| 6,161,914 A | | 12/2000 | Haselby | |
| 6,188,427 B1 | | 2/2001 | Anderson et al. | |
| 6,196,652 B1 | | 3/2001 | Subirada et al. | |
| 6,213,580 B1 | | 4/2001 | Segerstrom et al. | |
| 6,231,155 B1 | * | 5/2001 | Udagawa et al. | 347/19 |
| 6,234,602 B1 | | 5/2001 | Soto et al. | |
| 6,266,077 B1 | | 7/2001 | Kamimura | |

* cited by examiner

*Primary Examiner*—Craig Hallacher
*Assistant Examiner*—Charles W. Stewart, Jr.
(74) *Attorney, Agent, or Firm*—Elizabeth C. Jacobs; Douglas E. Erickson

(57) ABSTRACT

A method for determining a printhead misalignment of a printer. One step includes printing a printhead alignment test pattern including spaced-apart images at least partially aligned substantially along a printhead scan axis. A sensor is moved along the printhead scan axis at a known speed over the plurality of images. Sampled data points are obtained from the sensor at a known sampling rate. Another step includes determining the locations along the printhead scan axis of the edges of the images using the sampled data points, the known speed of the sensor, and the known sampling rate. An additional step includes calculating the printhead misalignment from the determined locations of the edges of the images.

35 Claims, 3 Drawing Sheets

METHOD FOR DETERMINING PRINTHEAD MISALIGNMENT OF A PRINTER

TECHNICAL FIELD

The present invention relates generally to printers, and more particularly to a method for determining printhead misalignment of a printer.

BACKGROUND OF THE INVENTION

Printers include inkjet printers having one or more printheads used to print on print media. An inkjet printhead typically includes a vertical array of inkjet nozzles. In some designs, the vertical array is a single line array aligned perpendicular to the printhead scan direction or aligned slightly tilted from perpendicular when the nozzles in the line array are fired with a time delay as is known to those skilled in the art. In other designs, the vertical array includes two or more vertical line segments horizontally spaced apart with the nozzles in one vertical line segment fired with a time delay relative to the nozzles in another vertical line segment as can be appreciated by the artisan. In still other designs, the vertical array includes two or more horizontally spaced-apart vertical lines or line segments, wherein a nozzle of one vertical line or line segment is positioned vertically between two adjacent nozzles of another vertical line or line segment. The term "printhead" means a group of pixel printing elements capable of causing any possible character or symbol (including a single or multi-pixel character or symbol) of a single color to be printed on the print media. The term "printhead" also includes the terms "pen" and "cartridge". A typical color inkjet printer has a black printhead and three color printheads (such as a cyan printhead, a yellow printhead, and a magenta printhead). In some designs, the three color printheads are three groups of nozzles on a single printhead block mounted to the printhead carriage. Printers having horizontally spaced-apart redundant printheads are known.

Print quality depends on the skew alignment of each printhead with respect to the printhead scan direction, on the bi-directional alignment of each printhead in the forward printhead scan direction relative to the reverse printhead scan direction, and on the horizontal and vertical alignments of one printhead relative to another printhead. A conventional method of printhead alignment includes printing an alignment pattern (having spaced-apart images) on the print media, passing a printhead-carriage-mounted optical sensor along the printhead scan direction over the alignment pattern to detect the alignment pattern, using a counter-timer to measure the time it takes the optical sensor to reach the leading and/or trailing edges of the images of the alignment pattern, calculating the positions of the images from the measured times of the counter timer, and determining the printhead misalignments from the calculated image positions. Another conventional method uses the printhead carriage encoder to determine the position of the images detected by a printhead-carriage-mounted optical sensor. Some of these methods use computationally-intensive algorithms requiring large memory space.

What is needed is an improved method for determining a printhead misalignment of a printer.

SUMMARY OF THE INVENTION

A first method of the invention is for determining a printhead misalignment of a printer and includes steps a) through e). Step a) includes printing a printhead alignment test pattern including spaced-apart images at least partially aligned substantially along a printhead scan axis. Step b) includes moving a sensor along the printhead scan axis at a known speed over the plurality of images. Step c) includes obtaining sampled data points from the sensor at a known sampling rate. Step d) includes determining the locations along the printhead scan axis of the edges of the images using the sampled data points, the known speed of the sensor, and the known sampling rate. Step e) includes calculating the printhead misalignment from the determined locations of the edges of the images.

A second method of the invention is for determining a printhead misalignment of an inkjet printer and includes steps a) through e). Step a) includes printing a printhead alignment test pattern including spaced-apart block images at least partially aligned substantially along a printhead scan axis. Step b) includes moving a printhead-carriage-mounted optical sensor along the printhead scan axis at a known printhead carriage speed over the block images. Step c) includes obtaining sampled data points from the optical sensor at a known sampling rate. Step d) includes determining the locations along the printhead scan axis of the edges of the block images using the sampled data points, the known printhead carriage speed of the optical sensor, and the known sampling rate. Step e) includes calculating the printhead misalignment from the determined locations of the edges of the block images.

A third method of the invention is for determining a printhead misalignment of a printer and includes steps a) through e). Step a) includes printing a printhead alignment test pattern including spaced-apart images at least partially aligned substantially along a printhead scan axis. Step b) includes moving a sensor along the printhead scan axis at a known speed over the images. Step c) includes obtaining sampled data points from the sensor at a known sampling rate, wherein the sampled data points are obtained as digitized data points from an analog-to-digital converter whose input is operatively connected to the output of the optical sensor. Step d) includes determining the locations along the printhead scan axis of the edges of the images using the sampled data points, the known speed of the sensor, and the known sampling rate, wherein the digitized data points of the odd-numbered images are compared against a first threshold value to determine the locations of the edges of the odd-numbered images, and wherein the digitized data points of the even-numbered images are compared against a second threshold value to determine the locations of the edges of the even-numbered images. Step e) includes calculating the printhead misalignment from the determined locations of the edges of the images.

A fourth method of the invention is for determining a printhead misalignment of a printer and includes steps a) through e). Step a) includes printing a printhead alignment test pattern including spaced-apart images at least partially aligned substantially along a printhead scan axis. Step b) includes moving a sensor along the printhead scan axis at a known speed over the images. Step c) includes obtaining sampled data points from the sensor at a known sampling rate, wherein the sampled data points are obtained as digital data points from a bi-stable comparator whose input is operatively connected to the output of the optical sensor, and wherein the bi-stable comparator compares the optical sensor output to a single threshold value to set the state of the digital data point output of the bi-stable comparator. Step d) includes determining the locations along the printhead scan axis of the edges of the images using the sample numbers which correspond to changes of state of the digital data points, the known speed of the sensor, and the known sampling rate. Step e) includes calculating the printhead misalignment from the determined locations of the edges of the images.

Several benefits and advantages are derived from one or more of the four methods of the invention. By obtaining sampled data points from the sensor, the positions of the edges of the printed images of the printhead alignment test pattern can be calculated from the known sampling rate and the known sensor speed, and printhead misalignment can be calculated from the determined edge locations. This avoids having to use the printhead carriage encoder or a clock to determine edge locations as is done in conventional methods for determining printhead misalignment of a printer. This also avoids the use of computationally-intensive algorithms.

DETAILED DESCRIPTION

Figure 1:
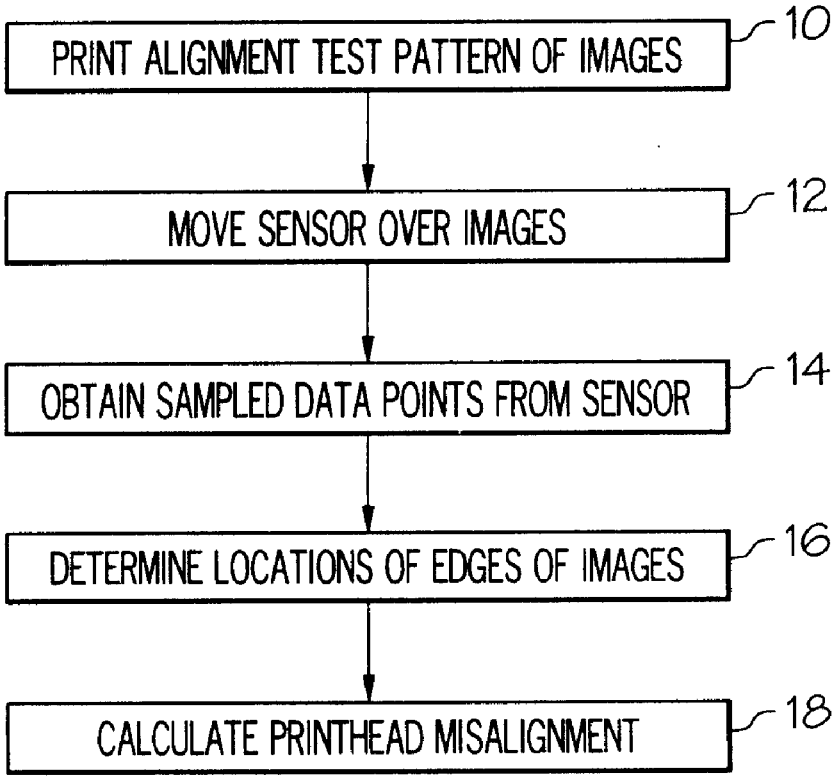
FIG. 1 is a flow chart of a first method of the invention.

A first method of the invention is for determining a printhead misalignment of a printer and is shown in flow chart form in FIG. 1. The method includes steps a) through e). Step a) is shown in block 10 of FIG. 1 and is labeled "Print Alignment Test Pattern Of Images". Step a) includes printing a printhead alignment test pattern including a plurality of spaced-apart images at least partially aligned substantially along a printhead scan axis. In one example, the images are substantially identical images. Step b) is shown in block 12 of FIG. 1 and is labeled "Move Sensor Over Images". Step b) includes moving a sensor along the printhead scan axis at a known speed over the plurality of images. Step c) is shown in block 14 of FIG. 1 and is labeled "Obtain Sampled Data Points From Sensor". Step c) includes obtaining sampled data points from the sensor at a known sampling rate. Step d) is labeled in block 16 of FIG. 1 as "Determine Locations Of Edges Of Images". Step d) includes determining the locations along the printhead scan axis of the edges of the plurality of images using the sampled data points, the known speed of the sensor, and the known sampling rate. Step e) is labeled in block 18 of FIG. 1 as "Calculate Printhead Misalignment". Step e) includes calculating the printhead misalignment from the determined locations of the edges of the plurality of images. In one variation, in step d) the locations of only the beginning or ending edges of the images are determined and in step e) used to calculate printhead misalignment. In another variation, in step d) the locations of both the beginning and ending edges of the images are determined and in step e) used to calculate printhead misalignment. In a further variation, in step d) the locations of the beginning (or ending) edge of a first image is determined and the locations of the ending (or beginning) edge of the second image is determined and in step e) used to calculate printhead misalignment. Other variations in selecting edges of images for step d) are left to the artisan.

As previously mentioned, the term "printhead" means a group of pixel printing elements capable of causing any possible character or symbol (including a single or multi-pixel character or symbol) of a single color to be printed on the print media. The term "printhead" also includes the terms "pen" and "cartridge". Printers having printheads include, without limitation, inkjet printers. A typical color inkjet printer has a black printhead and three color printheads (such as a cyan printhead, a yellow printhead, and a magenta printhead). In some designs, the three color printheads are three groups of nozzles on a single printhead block mounted to the printhead carriage. It is noted that some printers have horizontally spaced-apart redundant printheads.

In one embodiment, the sensor has an analog output which is sampled to obtain the sampled data points. In another embodiment, the sensor output itself consists of sampled data points. In one variation, the sampled data points are digitized data points each having more than two possible values. In another variation, the sampled data points are digital data points each having one of two possible values.

Figure 2:
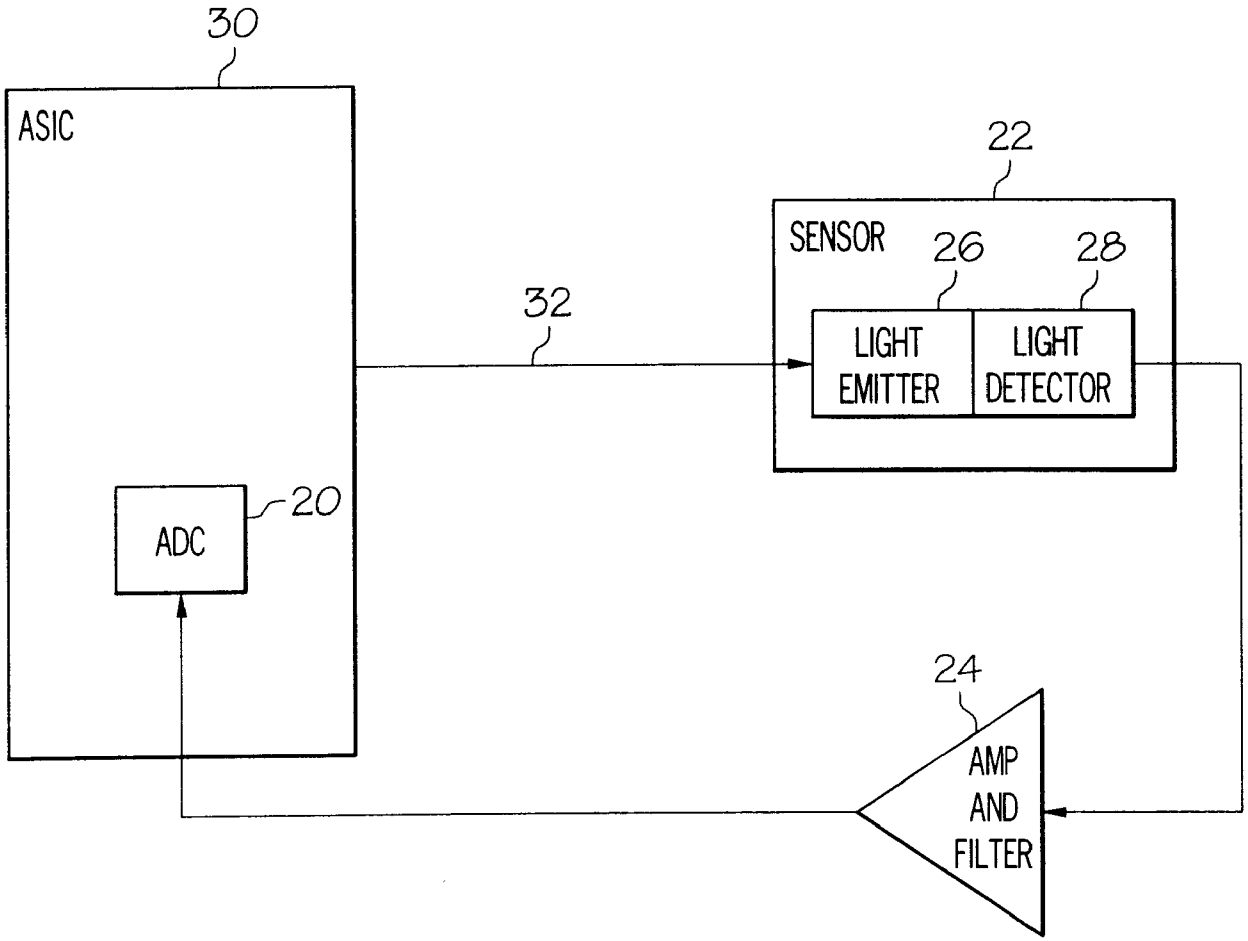
FIG. 2 is a block diagram of a first embodiment of apparatus for performing the last three steps of the method of FIG. 1.

In a first implementation of the first method, step c) includes obtaining the sampled data points as digitized data points from an analog-to-digital converter 20 whose input is operatively connected to the output of the sensor 22 (as seen in FIG. 2). It is noted that the input of the analog-to-digital converter 20 of the embodiment of FIG. 2 is operatively connected to the output of the sensor 22 through an intervening amplifier and low pass filter unit 24. An example, without limitation, of the sensor 22 is an optical sensor having a light emitter 26 in the form of a light emitting diode and having a light detector 28 in the form of a phototransistor. Other sensors are left to the artisan. In one construction, the analog-to-digital converter 20 is a portion of a printer controller ASIC (Application Specific Integrated Circuit) 30 which also contains other portions, not shown, such as a memory portion and a computational portion. The ASIC 30 outputs a PWM (pulse-width-modulated) signal 32 to drive the light emitter 26 (such as a red LED).

In one variation of the first implementation, the first method also includes the step of sequentially storing the digitized data points. In this variation, step d) includes determining the locations along the printhead scan axis of the edges of the plurality of images using the stored digitized data points. In one example, step d) includes comparing the stored digitized data points of the odd-numbered images against a first threshold value to determine the locations of the edges of the odd-numbered images and step d) includes comparing the stored digitized data points of the even-numbered images against a second threshold value to determine the locations of the edges of the even-numbered images. In one application, the second threshold value is the same as the first threshold value. In another application, the second threshold value is different from the first threshold value. In one modification, the odd-numbered images have a first color and the even-numbered images have a second color, wherein the second color is different from the first color, and wherein the second threshold value is different from the first threshold value. It is noted that differences in absorption of different colored inks (especially between cyan and black colored inks) causes the periodic peak and valley values of the sensor output to vary which can lead to errors in accurately detecting the edges of the images when a conventional single threshold value is used instead of using a first threshold value for the images of one color and a second threshold value for the images of another color.

Figure 3:
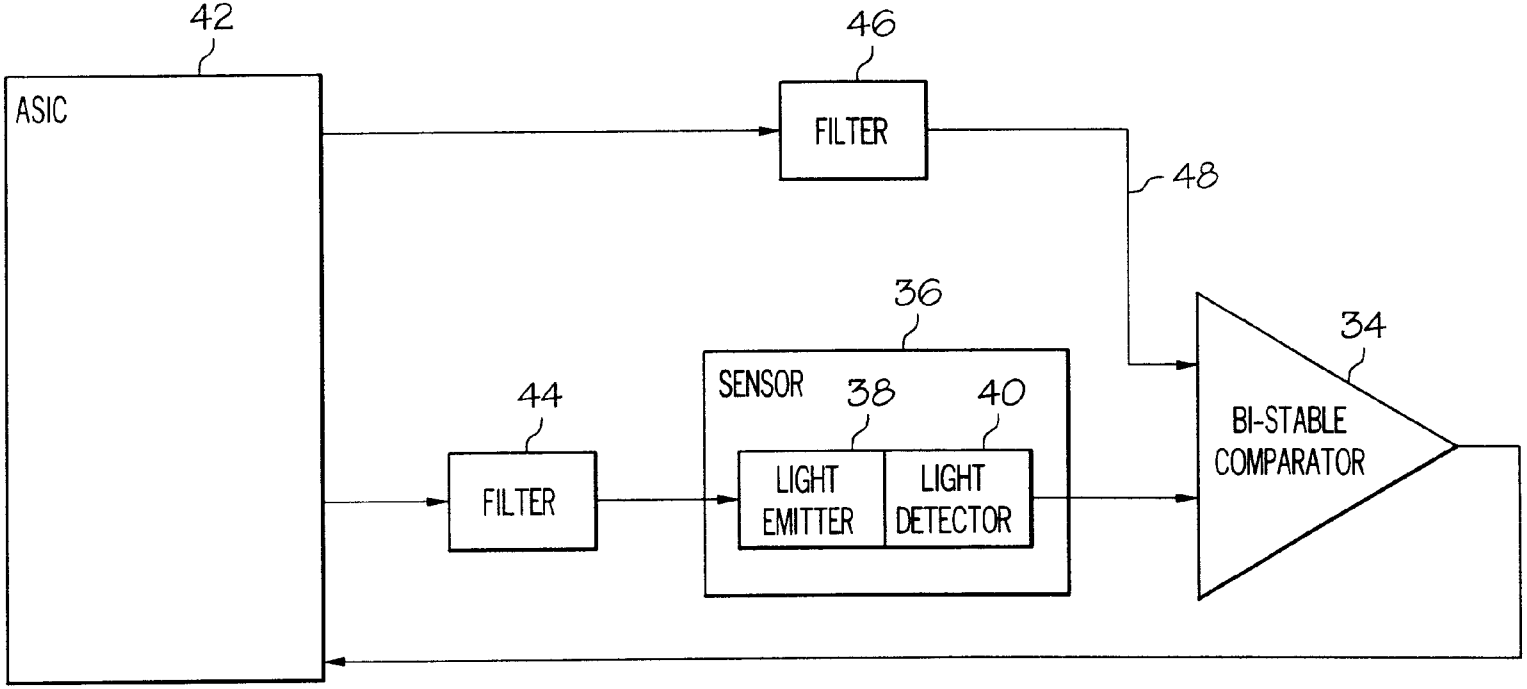
FIG. 3 is a block diagram of a second embodiment of apparatus for performing the last three steps of the method of FIG. 1.

In a second implementation of the first method, step c) includes obtaining the sampled data points as digital data points from a bi-stable comparator 34 (such as a Schmitt trigger) whose input is operatively connected to the output of the sensor 36 (as seen in FIG. 3). It is noted that the input of the bi-stable comparator 34 of the embodiment of FIG. 3 is operatively connected by a direct connection to the output of the sensor 36. An example of the sensor 36, without limitation, is an optical sensor having a light emitter 38 in the form of a light emitting diode and a light detector 40 in the form of a phototransistor. Other sensors are left to the artisan. In one construction, a printer controller ASIC 42 receives the output of the bi-stable comparator 34, outputs a PWM signal to a low pass filter 44 to drive the light emitter 38 (such as a red LED), and outputs a PWM signal to a low pass filter 46 to set the single threshold value of the bi-stable comparator 34.

In one variation of the second implementation of the first method, the bi-stable comparator 34 compares the sensor 36 output to a single threshold value to set the state of the digital data point output of the bi-stable comparator 34. In one design, the bi-stable comparator 34 has a value of one when the sensor 36 is over a non-inked area of the print media and has a value of zero when the sensor is over an inked area of the print media. In one variation of the second implementation, the first method also includes the steps of counting the number of samples and sequentially storing sample numbers which correspond to changes of state of the digital. data points. In this variation, step d) includes determining the locations along the printhead scan axis of the edges of the plurality of images using the stored sample numbers.

A second method of the invention is for determining a printhead misalignment of an inkjet printer and includes steps a) through e). Step a) includes printing a printhead alignment test pattern including a plurality of spaced-apart block images at least partially aligned substantially along a printhead scan axis. In one example, the block images are substantially identical, solid-ink block images. Step b) includes moving a printhead-carriage-mounted optical sensor along the printhead scan axis at a known printhead carriage speed over the plurality of block images. Step c) includes obtaining sampled data points from the optical sensor at a known sampling rate. Step d) includes determining the locations along the printhead scan axis of the edges of the plurality of block images using the sampled data points, the known printhead carriage speed of the optical sensor, and the known sampling rate. Step e) includes calculating the printhead misalignment from the determined locations of the edges of the plurality of block images.

The previously described variations, designs, embodiments, implementations, examples, constructions and modifications for the first method are equally applicable to the second method wherein, in one enablement of any step calling for storing digitized data points or sample numbers, they are stored in a memory of a printer controller ASIC (Application Specific Integrated Circuit), and step d) is performed by the printer controller ASIC.

In one alignment test pattern of the second method, the block images are substantially identical rectangular block images having side edges aligned substantially perpendicular to the printhead scan axis. In a first application of the second method, step a) prints the odd-numbered block images from a first printhead mounted on the printhead carriage moving in a first direction along the printhead scan axis, step a) prints the even-numbered block images from the first printhead moving in a direction opposite to the first direction, and step e) calculates the bi-directional misalignment of the first printhead. In a second application of the second method, step a) prints the odd-numbered block images from one of an upper portion and a lower portion of a first printhead mounted on the printhead carriage, step a) prints the even-numbered block images from the other of the upper portion and the lower portion of the first printhead, and step e) calculates the skew misalignment of the first printhead. In a third application of the second method, step a) prints the odd-numbered block images from a first printhead mounted on the printhead carriage, step a) prints the even-numbered block images from a second printhead mounted on the printhead carriage, and step e) calculates the horizontal misalignment of the second printhead relative to the first printhead.

In another alignment test pattern of the second method, the block images are substantially identical block images having side edges aligned at substantially the same acute angle (such as substantially 26.5 degrees or 45 degrees) to the printhead scan axis. In an application of the second method, step a) prints the odd-numbered block images from a first printhead mounted on the printhead carriage, step a) prints the even-numbered block images from a second printhead mounted on the printhead carriage, and step e) calculates the vertical misalignment of the second printhead relative to the first printhead from the determined locations of the edges of the plurality of block images and a previously-determined horizontal misalignment of the second printhead relative to the first printhead.

A third method of the invention is for determining a printhead misalignment of a printer and includes steps a) through e). Step a) includes printing a printhead alignment test pattern including a plurality of spaced-apart images at least partially aligned substantially along a printhead scan axis. In one example, the images are substantially identical images. Step b) includes moving a sensor along the printhead scan axis at a known speed over the plurality of images. Step c) includes obtaining sampled data points from the sensor at a known sampling rate, wherein the sampled data points are obtained as digitized data points from an analog-to-digital converter whose input is operatively connected to the output of the optical sensor. Step d) includes determining the locations along the printhead scan axis of the edges of the plurality of images using the sampled data points, the known speed of the sensor, and the known sampling rate, wherein the digitized data points of the odd-numbered images are compared against a first threshold value to determine the locations of the edges of the odd-numbered images, wherein the digitized data points of the even-numbered images are compared against a second threshold value to determine the locations of the edges of the even-numbered images, and wherein the second threshold value is different from the first threshold value. Step e) includes calculating the printhead misalignment from the determined locations of the edges of the plurality of images.

In one construction the sensor has a light emitter and a light detector, and in one example the third method also includes the initialization steps of moving the sensor over a non-print area of a print medium and calibrating the sensor by adjusting the intensity of the light emitted by the light emitter until sampled data points from the output of the light detector fall within a predetermined range of values. In one example, as seen in FIG. 2, this is accomplished by having the light emitter 26 driven by a filtered PWM signal 32 controlled by the ASIC 30. In one modification, the third method also includes the additional initialization steps of determining the first threshold value as substantially the midpoint of the maximum digitized data point and the minimum digitized data point of the odd-numbered block images and determining the second threshold value as substantially the midpoint of the maximum digitized data point and the minimum digitized data point of the even-numbered block images.

A fourth method of the invention is for determining a printhead misalignment of a printer and includes steps a) through e). Step a) includes printing a printhead alignment test pattern including a plurality of spaced-apart images at least partially aligned substantially along a printhead scan axis. In one example, the images are substantially identical images. Step b) includes moving a sensor along the printhead scan axis at a known speed over the plurality of images. Step c) includes obtaining sampled data points from the sensor at a known sampling rate, wherein the sampled data points are obtained as digital data points from a bi-stable comparator whose input is operatively connected to the output of the optical sensor, and wherein the bi-stable comparator compares the optical sensor output to a single threshold value to set the state of the digital data point output of the bi-stable comparator. Step d) includes determining the locations along the printhead scan axis of the edges of the plurality of images using the sample numbers which correspond to changes of state of the digital data points, the known speed of the sensor, and the known sampling-rate. Step e) includes calculating the printhead misalignment from the determined locations of the edges of the plurality of images.

In one construction the sensor has a light emitter and a light detector, and in one example the fourth method also includes the initialization step of adjusting at least one of the light intensity of the light emitter and the single threshold value. In another example, the fourth method also includes the initialization step of adjusting the light intensity of the light emitted by the light emitter, adjusting a low threshold value to be greater than an ink-area response of the light detector, and adjusting a high threshold value to be less than a non-ink-area response of the light detector all such that the high threshold value exceeds the low threshold value by a predetermined amount, and further including the initialization step of calculating the single threshold value as substantially the midpoint of the adjusted low and high threshold values. In one example, as seen in FIG. 3, the light emitter 38 is driven by a filtered PWM signal controlled by the ASIC 42, and the single threshold value is a filtered PWM signal 48 controlled by the ASIC 42.

It is noted that the constructions and initialization step or steps of the third and fourth methods are applicable to the previously described first and/or second methods as can be appreciated by the artisan.

In one illustration, when the analog-to-digital converter is used, of determining edge locations for step d) of any of the previously-discussed four methods, assume the sampling rate is 5,000 samples per second and the sensor speed is 5 inches per second. Dividing the sampling rate by the sampling speed gives 1,000 samples per inch which means that two sequential sampled data points are 0.001 inch apart. Assume the sampled data points are sequentially stored starting with sample number one, that sample numbers one through eighty are above the first threshold value for the odd-numbered images indicating the absence of an inked image, that sample numbers eighty-one through one hundred sixty are at or below the first threshold value indicating the presence of the first image, and that sample numbers one hundred sixty-one through two hundred forty-one are above the first threshold value. Then, referencing the first sample at 0.000 inch, the location of the leading edge of the first image is at 0.080 inch and the trailing edge of the first image is at 0.160 inch. This process is continued for the remaining odd-numbered images and repeated with the second threshold value for the even-numbered images. In one modification, if the bi-stable converter were used in place of the analog-to-digital converter, then assume that sample numbers one through eighty are "one" indicating the absence of an inked image, that sample numbers eighty-one through one hundred sixty are "zero" indicating the presence of the first image, and that sample numbers one hundred eighty-one through two hundred forty-one are "one". Then, the first change of state of the samples occurs at sample number eighty-one and the second change of state of the samples occurs at sample number one hundred sixty-one. Sample number eighty-one corresponds to a leading edge location for the first image of 0.080 inch and sample number one hundred sixty-one corresponds to a trailing edge location of the first image of 0.160 inch.

In one illustration for calculating printhead misalignment for step d) of any of the previously-discussed four methods, assume that the images are substantially identical images, that all edge locations have been determined, and that horizontal misalignment of the cyan printhead relative to the black printhead is to be calculated. The location of the center of the first image is calculated from the sum of the leading and trailing edge locations of the first image divided by two. The location of the center of the second image is calculated from the sum of the leading and trailing edge locations of the second image divided by two. The remaining locations of the centers are similarly calculated. The distances between the centers of adjoining images are calculated by subtracting the locations of adjoining centers. Using standard averaging techniques over all of the images, a misalignment is calculated as half the difference in the distance of the center of one image to the center of the preceding image and the distance of the center of that one image to the center of the succeeding image. No difference in distance indicates alignment. A difference indicates misalignment. Techniques to correct for printhead misalignment (such as adjusting the times for nozzle firing) are known in the art and do not form a part of the methods of the invention. In one embodiment, printhead misalignment is determined and corrected for automatically by the printer.

With vertical block images, when the odd-numbered images are printed by a first printhead in a forward scan along the printhead scan axis and the even-numbered images are printed by the first printhead in a reverse scan along the printhead scan axis, then the difference is a determination of the bi-directional misalignment of the first printhead. When the odd-numbered images are printed by a first printhead and the even-numbered images are printed by a second printhead, the difference is a determination of the horizontal misalignment of the second printhead relative to the first printhead. When the odd-numbered images are printed by an upper portion of a first printhead and the even-numbered images are printed by a lower portion of the first printhead, the difference is a determination of the skew misalignment of the first printhead.

With images having 45 degree (from the printhead scan axis) side edges, when the odd-numbered images are printed by a first printhead and :the even-numbered images are printed by a second printhead, the difference is used to determine the vertical misalignment of the second printhead relative to the first printhead when the horizontal misalignment has been previously determined. As can be appreciated by the artisan, the difference is a determination of the vertical plus horizontal misalignments, wherein the difference minus the previously-determined horizontal misalignment is a determination of the vertical misalignment. With images having 26.5 degree (from the printhead scan axis)

side edges, the vertical misalignment is twice the difference as is understood by those skilled in the art. The determination of vertical misalignment based on the difference and the previously-determined horizontal misalignment for other angles is left to the artisan and the laws of trigonometry.

Several benefits and advantages are derived from one or more of the four methods of the invention. By obtaining sampled data points from the sensor, the positions of the edges of the printed images of the printhead alignment test pattern can be calculated from the known sampling rate and the known sensor speed, and printhead misalignment can be calculated from the determined edge locations. This avoids having to use the printhead carriage encoder or a clock to determine edge locations as is done in conventional methods for determining printhead misalignment of a printer. This also avoids the use of computationally-intensive algorithms. An additional benefit is more accurate determination of edge locations, and hence printhead misalignment, by using dual thresholds when the sampled data points are obtained as digitized data points from an analog-to-digital converter.

The foregoing description of several methods of the invention has been presented for purposes of illustration. It is not intended to be exhaustive or to limit the invention to the precise methods disclosed, and obviously many modifications and variations are possible in light of the above teaching. It is intended that the scope of the invention be defined by the claims appended hereto.

What is claimed is:

1. A method for determining a printhead misalignment of a printer comprising the steps of:

a) printing a printhead alignment test pattern including a plurality of spaced-apart images at least partially aligned substantially along a printhead scan axis;

b) moving a sensor along the printhead scan axis at a known speed over the plurality of images;

c) obtaining sampled data points from the sensor at a known sampling rate;

d) determining the locations along the printhead scan axis of the edges of the plurality of images using the sampled data points, the known speed of the sensor, and the known sampling rate; and e) calculating the printhead misalignment from the determined locations of the edges of the plurality of images.

2. The method of claim 1, wherein step c) includes obtaining the sampled data points as digitized data points from an analog-to-digital converter whose input is operatively connected to the output of the sensor.

3. The method of claim 2, also including the step of sequentially storing the digitized data points.

4. The method of claim 3, wherein step d) includes determining the locations along the printhead scan axis of the edges of the plurality of images using the stored digitized data points.

5. The method of claim 4, wherein step d) includes comparing the stored digitized data points of the odd-numbered images against a first threshold value to determine the locations of the edges of the odd-numbered images, and wherein step d) includes comparing the stored digitized data points of the even-numbered images against a second threshold value to determine the locations of the edges of the even-numbered images.

6. The method of claim 5, wherein the odd-numbered images have a first color, wherein the even-numbered images have a second color, wherein the second color is different from the first color, and wherein the second threshold value is different from the first threshold value.

7. The method of claim 1, wherein step c) includes obtaining the sampled data points as digital data points from a bi-stable comparator whose input is operatively connected to the output of the sensor.

8. The method of claim 7, wherein the bi-stable comparator compares the sensor output to a single threshold value to determine the state of the digital data point output of the bi-stable comparator.

9. The method of claim 8, also including the steps of counting the number of samples and sequentially storing sample numbers which correspond to changes of state of the digital data points.

10. The method of claim 9, wherein step d) includes determining the locations along the printhead scan axis of the edges of the plurality of images using the stored sample numbers.

11. A method for determining a printhead misalignment of an inkjet printer comprising the steps of:

a) printing a printhead alignment test pattern including a plurality of spaced-apart block images at least partially aligned substantially along a printhead scan axis;

b) moving a printhead-carriage-mounted optical sensor along the printhead scan axis at a known printhead carriage speed over the plurality of block images;

c) obtaining sampled data points from the optical sensor at a known sampling rate;

d) determining the locations along the printhead scan axis of the edges of the plurality of block images using the sampled data points, the known printhead carriage speed of the optical sensor, and the known sampling rate; and e) calculating the printhead misalignment from the determined locations of the edges of the plurality of block images.

12. The method of claim 11, wherein step c) includes obtaining the sampled data points as digitized data points from an analog-to-digital converter whose input is operatively connected to the output of the optical sensor.

13. The method of claim 12, also including the step of sequentially storing the digitized data points in a memory of a printer controller ASIC (Application Specific Integrated Circuit).

14. The method of claim 13, wherein step d) includes the printer controller ASIC determining the locations along the printhead scan axis of the edges of the plurality of images using the stored digitized data points, and wherein step e) includes the printer controller ASIC calculating the printhead misalignment from the determined locations of the edges of the plurality of block images.

15. The method of claim 14, wherein step d) includes the printer controller ASIC comparing the stored digitized data points of the odd-numbered images against a first threshold value to determine the locations of the edges of the odd-numbered images, and wherein step d) includes the printer controller ASIC comparing the stored digitized data points of the even-numbered images against a second threshold value to determine the locations of the edges of the even-numbered images.

16. The method of claim 15, wherein the odd-numbered images have a first color, wherein the even-numbered images have a second color, wherein the second color is different from the first color, and wherein the second threshold value is different from the first threshold value.

17. The method of claim 16, wherein the optical sensor has a light emitter and a light detector, and also including the initialization steps of moving the optical sensor over a non-print area of a print medium and calibrating the optical sensor by adjusting the intensity of the light emitted by the light emitter until sampled data points from the output of the light detector fall within a predetermined range of values.

18. The method of claim 17, also including the additional initialization steps of determining the first threshold value as substantially the midpoint of the maximum digitized data point and the minimum digitized data point of the odd-numbered block images and determining the second threshold value as substantially the midpoint of the maximum digitized data point and the minimum digitized data point of the even-numbered block images.

19. The method of claim 11, wherein step c) includes obtaining the sampled data points as digital data points from a bi-stable comparator whose input is operatively connected to the output of the optical sensor.

20. The method of claim 19, wherein the bi-stable comparator compares the optical sensor output to a single threshold value to set the state of the digital data point output of the bi-stable comparator.

21. The method of claim 20, wherein the optical sensor has a light emitter and a light detector, and also including the initialization step of adjusting at least one of the light intensity of the light emitter and the single threshold value.

22. The method of claim 20, wherein the optical sensor has a light emitter and a light detector, and also including the initialization step of adjusting the light intensity of the light emitted by the light emitter, adjusting a low threshold value to be greater than an ink-area response of the light detector, and adjusting a high threshold value to be less than a non-ink-area response of the light detector all such that the high threshold value exceeds the low threshold value by a predetermined amount, and further including the initialization step of calculating the single threshold value as substantially the midpoint of the adjusted low and high threshold values.

23. The method of claim 20, also including the steps of counting the number of samples and sequentially storing sample numbers in a memory of a printer controller ASIC (Application Specific Integrated Circuit) which correspond to changes of state of the digital data points.

24. The method of claim 23, wherein step d) includes the printer controller ASIC determining the locations along the printhead scan axis of the edges of the plurality of block images using the stored sample numbers, and wherein step e) includes the printer controller ASIC calculating the printhead misalignment from the determined locations of the edges of the plurality of block images.

25. The method of claim 11, wherein the block images are substantially identical rectangular block images having side edges aligned substantially perpendicular to the printhead scan axis.

26. The method of claim 25, wherein step a) prints the odd-numbered block images from a first printhead mounted on the printhead carriage moving in a first direction along the printhead scan axis, wherein step a) prints the even-numbered block images from the first printhead moving in a direction opposite to the first direction, and wherein step e) calculates the bi-directional misalignment of the first printhead.

27. The method of claim 25, wherein step a) prints the odd-numbered block images from one of an upper portion and a lower portion of a first printhead mounted on the printhead carriage, wherein step a) prints the even-numbered block images from the other of the upper portion and the lower portion of the first printhead, and wherein step e) calculates the skew misalignment of the first printhead.

28. The method of claim 25, wherein step a) prints the odd-numbered block images from a first printhead mounted on the printhead carriage, wherein step a) prints the even-numbered block images from a second printhead mounted on the printhead carriage, and wherein step e) calculates the horizontal misalignment of the second printhead relative to the first printhead.

29. The method of claim 11, wherein the block images are substantially identical block images having side edges aligned at substantially the same acute angle to the printhead scan axis, wherein step a) prints the odd-numbered block images from a first printhead mounted on the printhead carriage, wherein step a) prints the even-numbered block images from a second printhead mounted on the printhead carriage, and wherein step e) calculates the vertical misalignment of the second printhead relative to the first printhead from the determined locations of the edges of the plurality of block images and a previously-determined horizontal misalignment of the second printhead relative to the first printhead.

30. A method for determining a printhead misalignment of a printer comprising the steps of:

a) printing a printhead alignment test pattern including a plurality of spaced-apart images at least partially aligned substantially along a printhead scan axis;

b) moving a sensor along the printhead scan axis at a known speed over the plurality of images;

c) obtaining sampled data points from the sensor at a known sampling rate, wherein the sampled data points are obtained as digitized data points from an analog-to-digital converter whose input is operatively connected to the output of the optical sensor;

d) determining the locations along the printhead scan axis of the edges of the plurality of images using the sampled data points, the known speed of the sensor, and the known sampling rate, wherein the digitized data points of the odd-numbered images are compared against a first threshold value to determine the locations of the edges of the odd-numbered images, and wherein the digitized data points of the even-numbered images are compared against a second threshold value to determine the locations of the edges of the even-numbered images; and e) calculating the printhead misalignment from the determined locations of the edges of the plurality of images.

31. The method of claim 30, wherein the sensor has a light emitter and a light detector, and also including the initialization steps of moving the sensor over a non-print area of a print medium and calibrating the sensor by adjusting the intensity of the light emitted by the light emitter until sampled data points from the output of the light detector fall within a predetermined range of values.

32. The method of claim 31, also including the additional initialization steps of determining the first threshold value as substantially the midpoint of the maximum digitized data point and the minimum digitized data point of the odd-numbered block images and determining the second threshold value as substantially the midpoint of the maximum digitized data point and the minimum digitized data point of the even-numbered block images.

33. A method for determining a printhead misalignment of a printer comprising the steps of:

a) printing a printhead alignment test pattern including a plurality of spaced-apart images at least partially aligned substantially along a printhead scan axis;

b) moving a sensor along the printhead scan axis at a known speed over the plurality of images;

c) obtaining sampled data points from the sensor at a known sampling rate, wherein the sampled data points are obtained as digital data points from a bi-stable comparator whose input is operatively connected to the output of the optical sensor, and wherein the bi-stable comparator compares the optical sensor output to a single threshold value to set the state of the digital data point output of the bi-stable comparator;

d) determining the locations along the printhead scan axis of the edges of the plurality of images using the sample numbers which correspond to changes of state of the digital data points, the known speed of the sensor, and the known sampling rate; and e) calculating the printhead misalignment from the determined locations of the edges of the plurality of images.

34. The method of claim 33, wherein the optical sensor has a light emitter and a light detector, and also including the initialization step of adjusting at least one of the light intensity of the light emitter and the single threshold value.

35. The method of claim 33, wherein the optical sensor has a light emitter and a light detector, and also including the initialization step of adjusting the light intensity of the light emitted by the light emitter, adjusting a low threshold value to be greater than an ink-area response of the light detector, and adjusting a high threshold value to be less than a non-ink-area response of the light detector all such that the high threshold value exceeds the low threshold value by a predetermined amount, and further including the initialization step of calculating the single threshold value as substantially the midpoint of the adjusted low and high threshold values.

* * * * *